US005562236A

United States Patent [19]

Monzingo

[11] Patent Number: 5,562,236

[45] Date of Patent: Oct. 8, 1996

[54] MODULAR BACKPACK PANNIER LUGGAGE

[76] Inventor: Damon P. Monzingo, P.O. BOX 60370, Fairbanks, Ak. 99706-0370

[21] Appl. No.: 359,741

[22] Filed: Dec. 20, 1994

[51] Int. Cl.[6] ..... A45F 4/02

[52] U.S. Cl. ..... 224/153; 224/154; 224/575

[58] Field of Search ..... 224/153, 151, 224/209, 210, 214, 154, 156; 190/102, 110, 109

[56] References Cited

U.S. PATENT DOCUMENTS

| | | | |
|---|---|---|---|
| 3,061,057 | 10/1962 | Miller | 190/110 |
| 3,443,671 | 5/1969 | Dyke | 190/110 |
| 4,420,068 | 12/1983 | Gercs | 190/110 |
| 4,433,802 | 2/1984 | Woolf | 224/153 |
| 5,184,763 | 2/1993 | Blaisdell et al. | 224/153 |

*Primary Examiner*—David J. Walczak

[57] ABSTRACT

A modular backpack which may be reconfigured into luggage or carrying articles. The assembly includes first and second backpacks each of which may be separated into upper and lower compartments. The lower compartments may then be coupled together to form a transportable piece of luggage, and the upper compartments are similarly couplable to form a further piece of luggage. The assembly also includes a tent extendable from the backpack, as well as an extensible elastic pack cover for protecting the backpack from rain or the like.

16 Claims, 12 Drawing Sheets

10
12
14
16
18
20
22
24
26
28
28
30
42
26
22

10
12
14
16
18
18
22
22
24
30

MODULAR BACKPACK PANNIER LUGGAGE

BACKGROUND OF THE INVENTION

1. Field of the Invention

The present invention relates to article carriers and more particularly pertains to a set of modular backpack panniers which may be reconfigured into luggage for carrying articles.

2. Description of the Prior Art

The use of article carriers is known in the prior art. More specifically, article carriers heretofore devised and utilized for the purpose of carrying articles upon the back of a user are known to consist basically of familiar, expected and obvious structural configurations, notwithstanding the myriad of designs encompassed by the crowded prior art which have been developed for the fulfillment of countless objectives and requirements.

For example, a combination pack frame, cot and tent is illustrated in U.S. Pat. No. 4,234,005 which comprises two principal parts, the first being a pack frame which is to be secured to a persons back, and the second being the lightweight tubular folding structure which forms the cot and the remainder of the tent support.

Another patent of interest is U.S. Pat. No. 3,822,813 which teaches a back pack frame for supporting a tent. The device includes a pair of spaced parallel L-shaped frame members which may be secured to an upright support member, such as a tree, whereby the frame members extend orthogonally from the tree and parallel to a ground surface to support a tent structure therebetween.

Other know prior art article carriers include U.S. Pat. No. 4,883,206; U.S. Pat. No. 4,035,855; and U.S. Pat. No. 4,526,307.

While these devices fulfill their respective, particular objectives and requirements, the aforementioned patents do not disclose a set of back pack panniers which may be reconfigured into luggage for carrying articles that includes first and second backpacks each of which may be separated into upper and lower compartments, with the lower compartments being couplable together to form a transportable piece of luggage, and the upper compartments being similarly couplable together to form a further piece of luggage. Furthermore, none of the known prior art article carriers teach or suggest a set of modular back pack pannier luggage assembly of the aforementioned structure which further includes a tent extendable from the back pack, as well as an extensible elastic pack cover for protecting the backpack from rain or the like.

In these respects, the modular backpack pannier luggage according to the present invention substantially departs from the conventional concepts and designs of the prior art, and in so doing provides an apparatus primarily developed for the purpose of carrying articles within mountain bike panniers which may be reconfigured into back packs or luggage.

SUMMARY OF THE INVENTION

In view of the foregoing disadvantages inherent in the known types of article carriers now present in the prior art, the present invention provides a new modular backpack pannier luggage construction wherein the same can be utilized for carrying articles upon a mountain bike or the back of an individual. As such, the general purpose of the present invention, which will be described subsequently in greater detail, is to provide a new modular backpack pannier luggage apparatus and method which has many of the advantages of the article carriers mentioned heretofore and many novel features that result in modular backpack pannier luggage which is not anticipated, rendered obvious, suggested, or even implied by any of the prior art article carriers, either alone or in any combination thereof.

To attain this, the present invention generally comprises a modular backpack which may be reconfigured into luggage for carrying articles. The assembly includes first and second backpacks each of which may be separated into upper and lower compartments. The lower compartments may then be coupled together to form a transportable piece of luggage, and the upper compartments are similarly couplable to form a further piece of luggage. The assembly also includes a tent extendable from the backpack, as well as an extensible elastic pack cover for protecting the backpack from rain or the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new set of modular backpack pannier luggage which has many of the advantages of the article carriers mentioned heretofore and many novel features that result in a modular backpack pannier luggage which is not anticipated, rendered obvious, suggested, or even implied by any of the prior art article carriers, either alone or in any combination thereof.

It is another object of the present invention to provide a new set of modular backpack pannier luggage which may be easily and efficiently manufactured and marketed.

It is a further object of the present invention to provide a new set of modular backpack pannier luggage which is of a durable and reliable construction.

An even further object of the present invention is to provide a new set of modular backpack pannier luggage which is susceptible of a low cost of manufacture with regard to both materials and labor, and which accordingly is then susceptible of low prices of sale to the consuming public, thereby making such modular backpack pannier luggage economically available to the buying public.

Still yet another object of the present invention is to provide a new set of modular backpack pannier luggage which provides in the apparatuses and methods of the prior art some of the advantages thereof, while simultaneously overcoming some of the disadvantages normally associated therewith.

Still another object of the present invention is to provide a new set of modular backpack panniers which may be reconfigured into luggage for carrying articles.

Yet another object of the present invention is to provide a new modular backpack pannier luggage assembly, which includes first and second panniers or backpacks, each of which may be separated into upper and lower compartments, with the lower compartments being couplable together to form a transportable piece of luggage, and the upper compartments being similarly couplable to form a further piece of luggage.

Even still another object of the present invention is to provide a new set of modular backpack pannier luggage assembly which includes a tent extendable from the back pack, as well as an extensible elastic pack cover for protecting the backpack from rain or the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
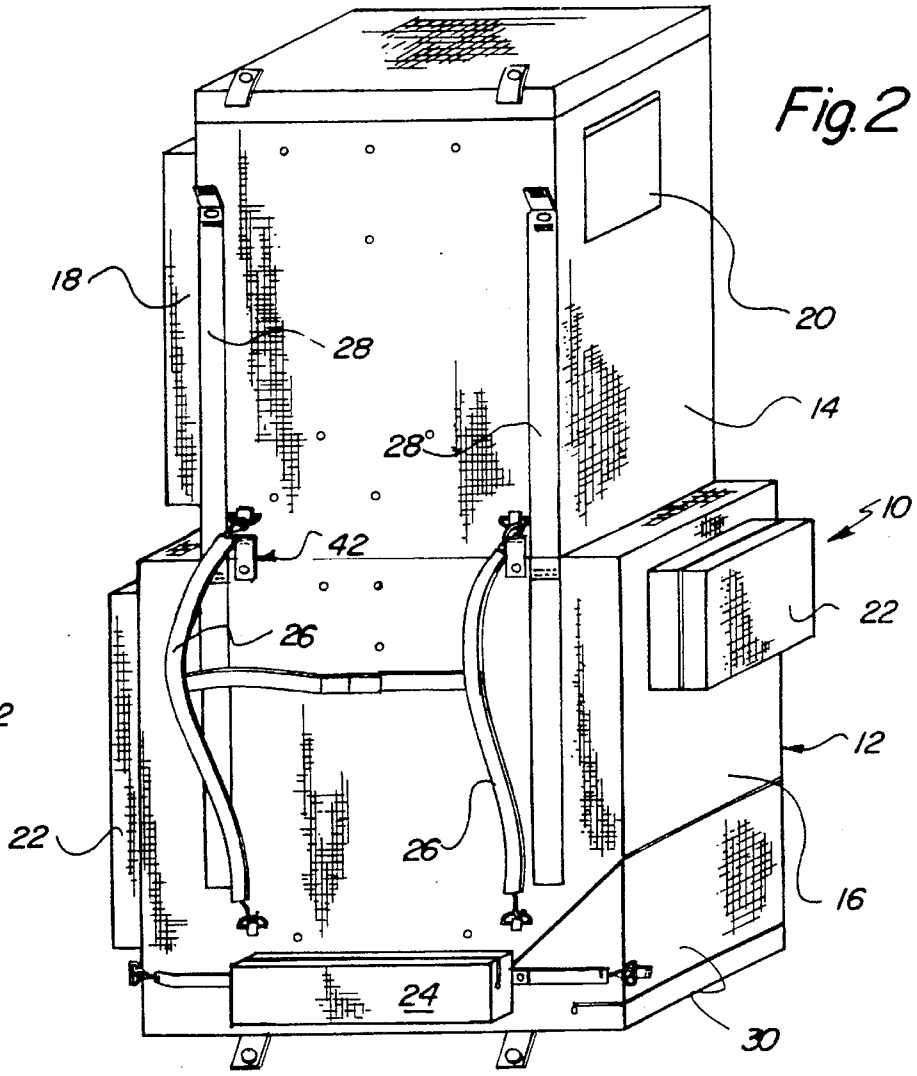
FIG. 2 is a front isometric view of the first backpack.

With reference now to the drawings, and in particular to FIGS. 1–27 thereof, a set of new modular backpack pannier luggage assembly embodying the principles and concepts of the present invention and generally designated by the reference numeral will be described.

Figure 1:
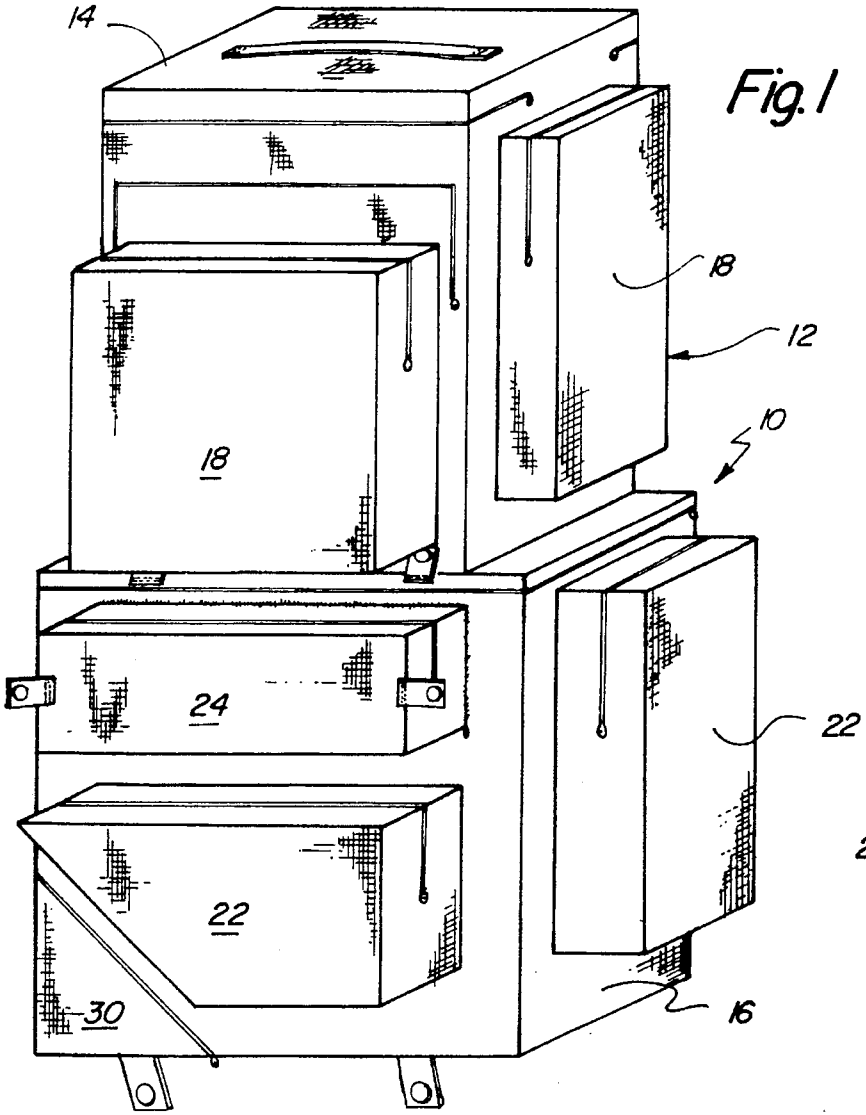
FIG. 1 is a rear isometric view of a first backpack comprising a portion of the present invention.

More specifically, it will be noted that the modular backpack pannier luggage 10 comprises a first backpack 12 having a first upper bag 14 removably coupled to a first lower bag 16, as best illustrated in FIGS. 1 and 2. The first upper bag 14 is substantially rectangular in shape and is removably coupled to a top end of the first lower bag 16. The first upper bag 14 is provided with a plurality of upper bag auxiliary compartments 18 having zippered openings which allow for storage of articles therewithin. In addition the first upper bag 14 further includes an upper bag mesh pocket 20 coupled to a side of the first upper bag for retaining small articles in an easily accessible manner, as well as retaining damp or wet articles for drying. Similarly, the first lower bag 16 includes a plurality of lower bag auxiliary compartments 22, including a waist pack compartment 24 removably coupled to a rear of the first lower bag, as illustrated in FIG. 1. The waist pack compartment 24 operable to be removed from the first lower bag 16, whereby it may be attached to an individual in a manner similar to that of a conventionally known belt by encompassing the waist of the individual. As illustrated in FIG. 2, the waist pack compartment 24 is further operable to be attached to a front of the first lower bag 16, whereby it engages the lower back of the individual carrying the first backpack pannier to provide lumbar support to the individual, when the backpack pannier 12 is positioned upon a back of the individual. To this end, a pair of shoulder straps 26 are removably attached to the first backpack pannier 2 and cooperate to retain the backpack pannier upon the back of the individual. To facilitate the transportation of tent poles, a pair of pole pockets 28 extend along opposed edges of the front face of the first upper bag 14 and the first lower bag 16 and are further colinearly arranged such that a tent pole or the like positioned within each of the pole pockets 18 rigidifies the removable coupling between the first upper bag and the first lower bag. Lastly, the first lower bag 16 is provided with a corner compartment 30 which is removably attached by a corner compartment zipper.

Figure 4:
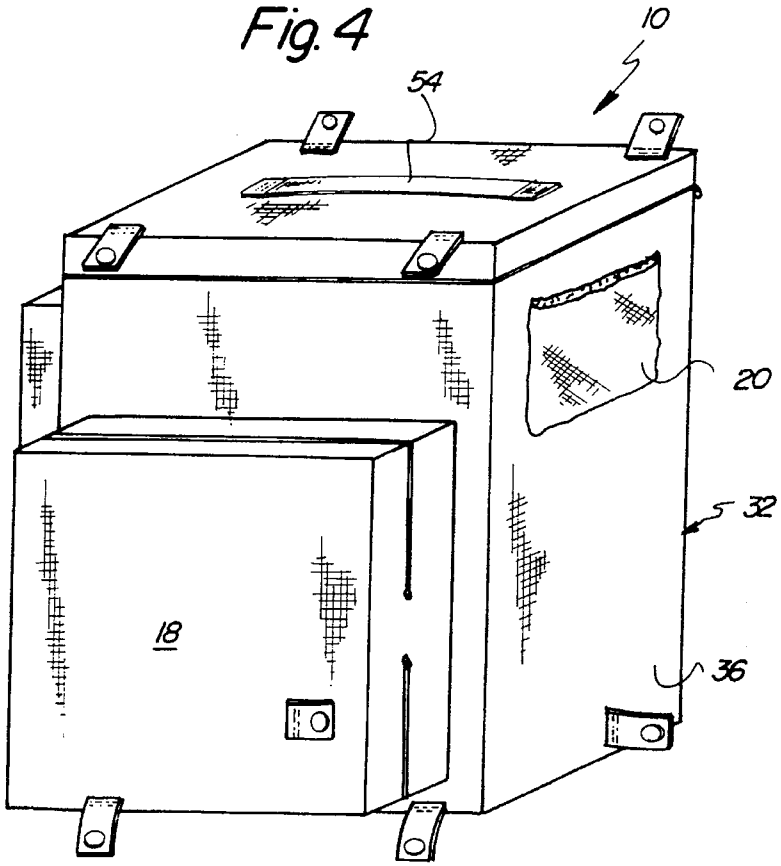
FIG. 4 is a rear isometric view of a second upper bag of the second backpack.
Figure 3:
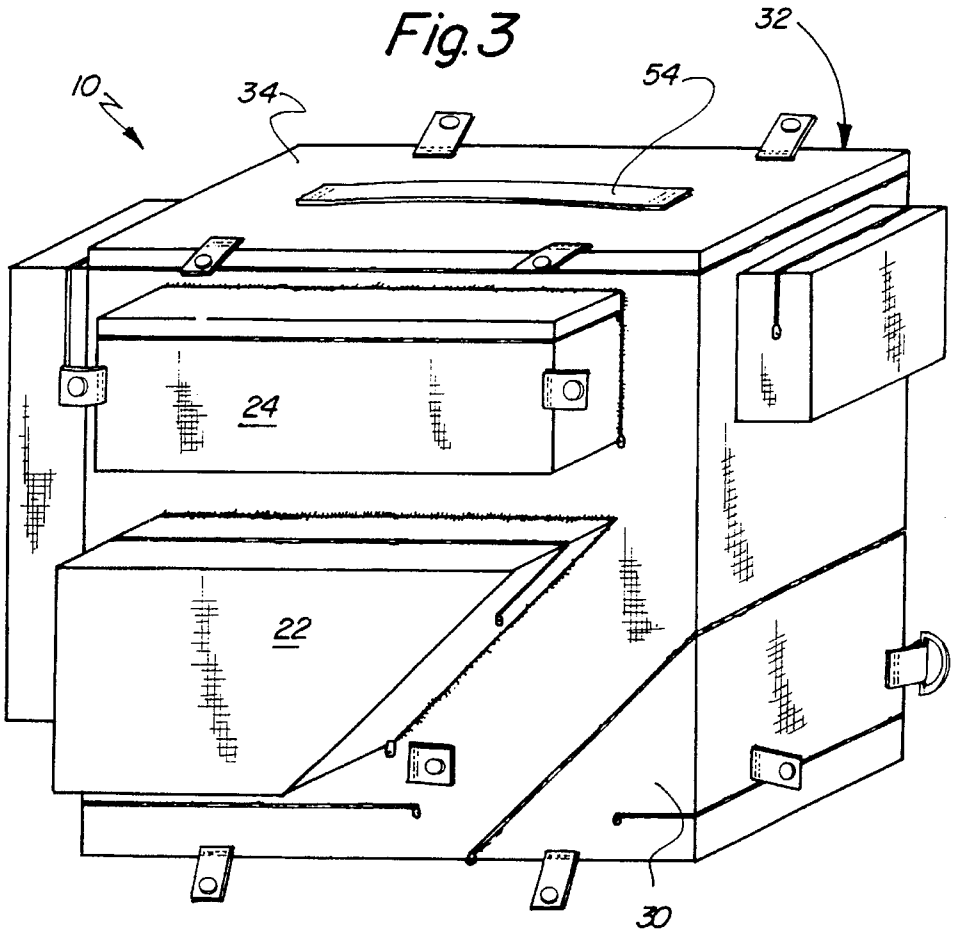
FIG. 3 is a rear isometric view of a second lower bag comprising a portion of a second backpack.

The modular back pack pannier luggage assembly 10 of the present invention further comprises a second backpack pannier 32 of substantially similar configuration relative to the first backpack pannier 12, as illustrated in FIGS. 3 and 4. Thus, it can be seen from these figures that the second backpack pannier 32 comprises a second lower bag 34 having lower bag auxiliary compartments 22 of substantially similar configuration relative to the lower bag auxiliary compartments of the first lower bag 16, including a waist pack compartment 24 which may be attached around the waist of an individual or, alternatively, utilized as a lumbar supporting device. The second lower bag similarly includes a corner compartment 30 attached by a corner compartment zipper. Thus, the corner compartments 30 of the first lower bag 16 and the second lower bag 34 may be decoupled from the respective lower bags and coupled together to form a substantially rectangular duffle bag.

The second back pack pannier 32 also includes a second upper bag 36 of substantially similar construction relative to the first upper bag 14, including the upper bag auxiliary compartments 18 and the upper bag mesh pocket 20. However, as can be readily ascertained from the drawings, the upper bags 14, 36 are constructed as mirror images of one another. Similarly, the lower bags 16, 34 are also constructed as mirror images of one another. In other words, the location of the auxiliary compartments 18, 22 of the respective upper bags 14, 36 and lower bags 16, 34 are oppositely positioned relative to one another.. However, such opposite positioning or mirror image construction of the first back pack pannier 12 relative to the second back pack pannier 32 is not essential to the invention, although such construction is preferable for reasons which will henceforth be described.

Figure 5:
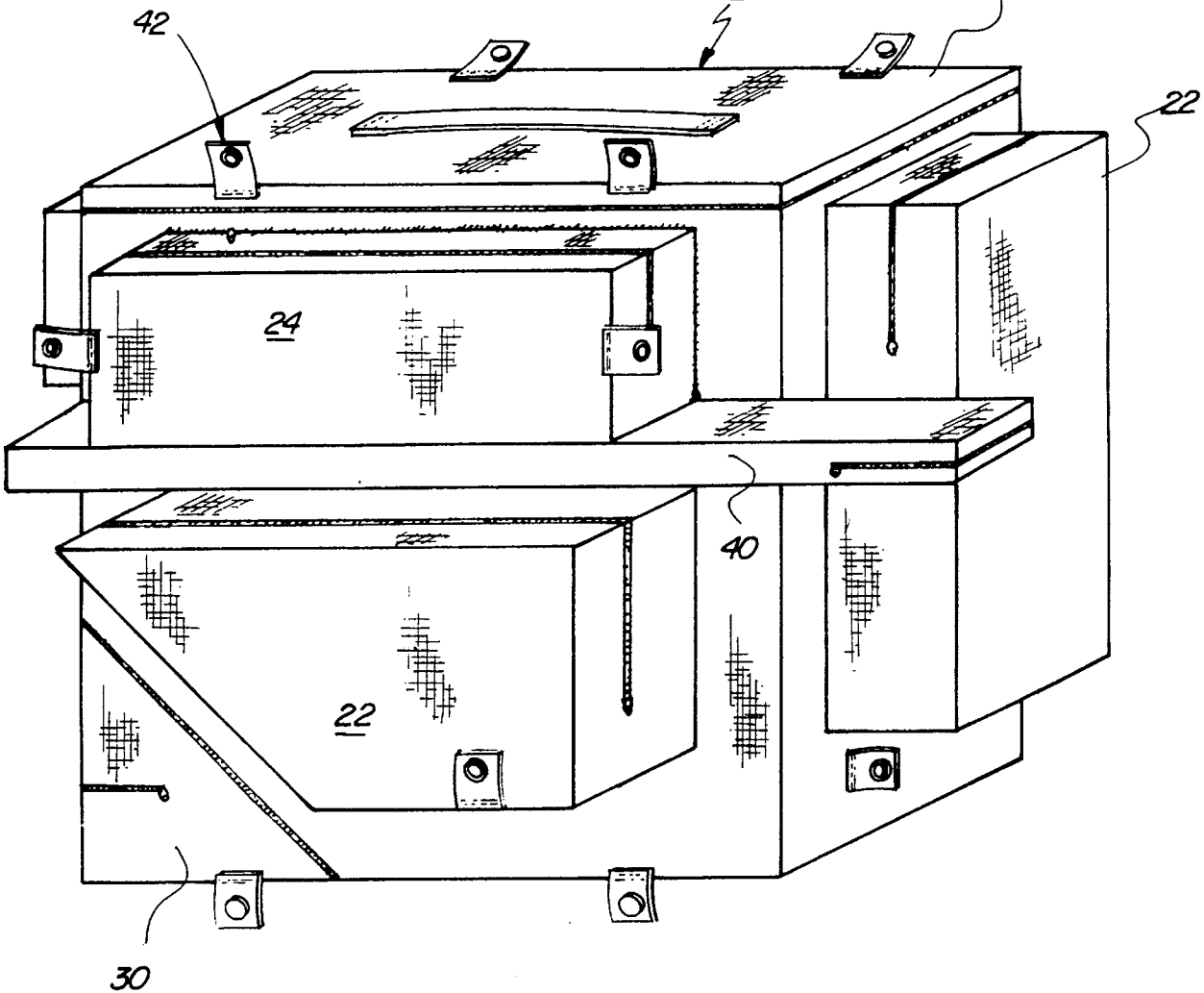
FIG. 5 is a rear isometric view of a first lower bag of the first backpack.

FIG. 5 illustrates the first lower bag 16 of the first back pack pannier 12 as further including a pole compartment 40 which may be utilized to store additional tent poles. The pole compartment 40 is equipped with removable fasteners, such as velcro or the like, which allow it to be removably coupled to either of the back packs 12, 32 as illustrated in FIG. 5 in a horizontal position, or in an unillustrated vertical position as well.

Figure 6:
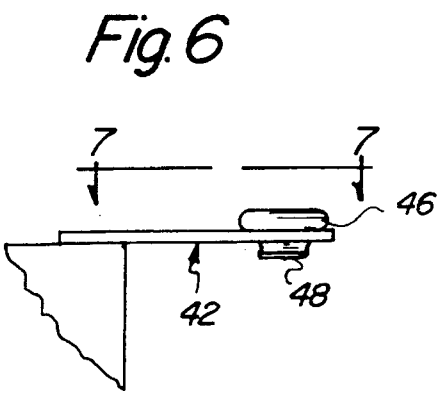
FIG. 6 is a side elevation view of the fastening means of the present invention.
Figure 7:
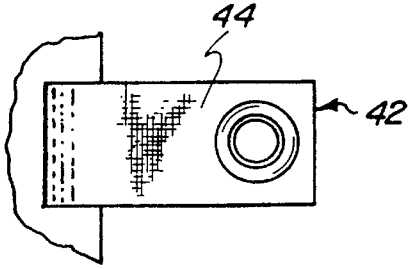
FIG. 7 is a top plan view of the fastening means as viewed from line 7—7 of FIG. 6.
Figure 27:
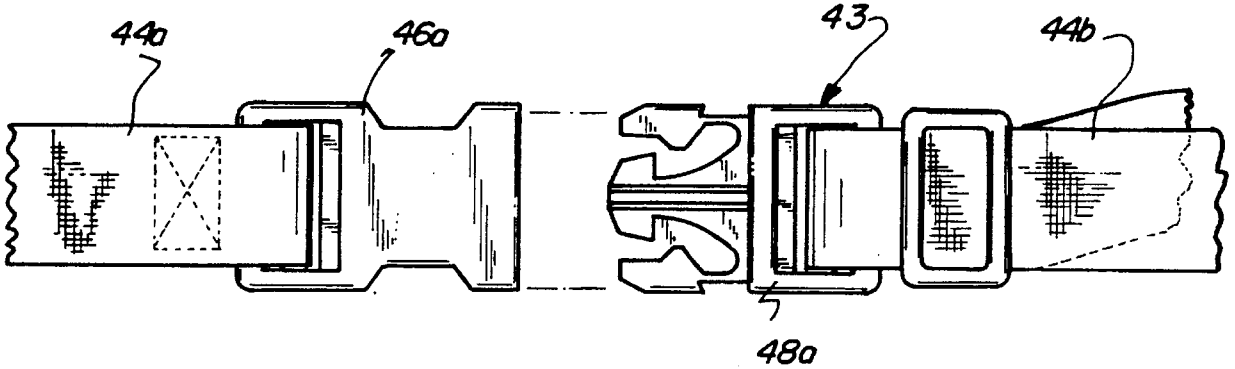
FIG. 27 is a plan view of an alternative fastening means of the present invention.

FIG. 6 and 7 illustrate the fastening means 42 utilized to removably couple components of the back packs 12, 32 together, and can be seen from these figures that the fastening means comprises a strap 44 having a female snap fastener 46 which removably engages a male snap fastener 48 to couple the components together, such as the first upper bag 14 to the first lower bag 16 as illustrated in FIG. 2, for example. Although snap fasteners 46, 48 have been illustrated as the preferred fastening means, it is contemplated that other conventionally known fasteners may be utilized as well, such as zippers, buttons, clips, threaded members, rotatably engaged coupling members, or the like. Thus, the use of snap fasteners 46, 48 is the preferred fastening means 42, but should not be regarded as limiting thereto. In this respect, an alternative fastening means 43 is illustrated in FIG. 27 of the drawings, including a strap **44*a* having a female fastener 46*a* which removably engages a male fastener 48*a* coupled to a further strap 44*b***.

Figure 9:
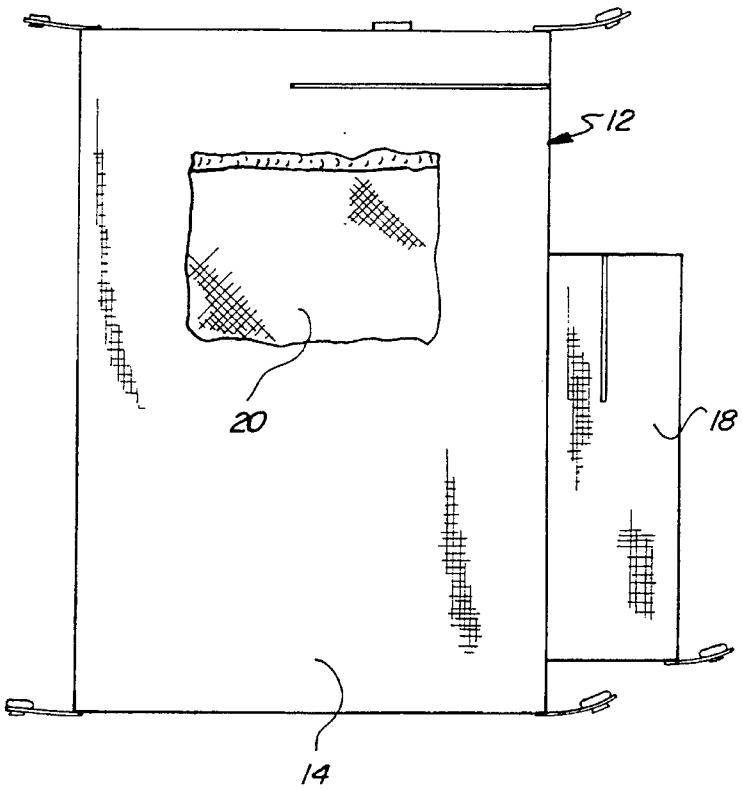
FIG. 9 is a side elevational view of the first upper bag.
Figure 8:
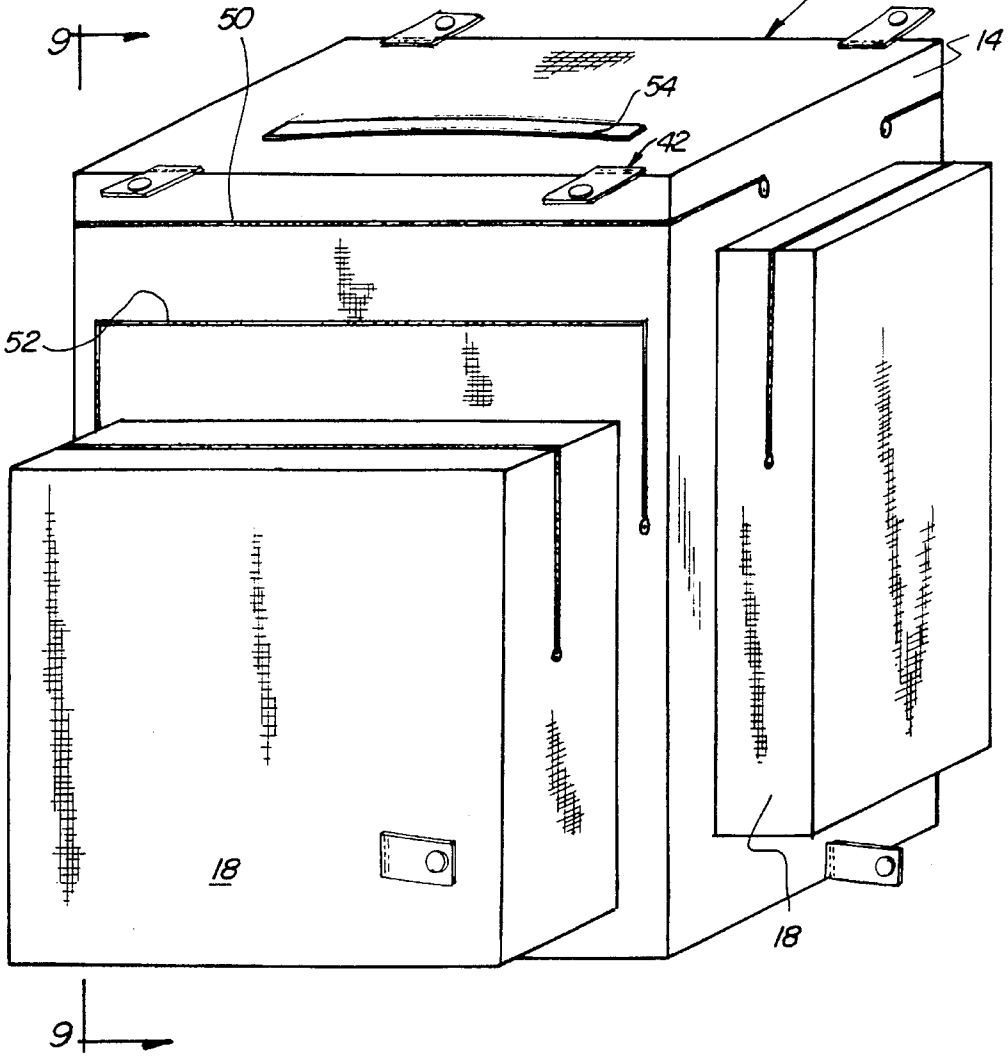
FIG. 8 is a rear isometric view of a first upper bag of the first backpack.

FIGS. 8 and 9 illustrate the first upper bag 14 of the first back pack pannier 12 and it can be seen from these figures that the first upper bag includes a plurality of zippers to permit access to an interior of the bag as well as into the upper bag auxiliary compartments 18. Excluding the zippers of the upper bag auxiliary compartments 18, the zippers of the upper bag 14 include a lid zipper 50 and a rear zipper 52, thereby providing multiple paths of entry into the interior of the upper bag 14. In addition, it should be realized that all of the bags 14, 16, as well as 34, 36 are provided with lid zippers 50 permitting access into the interiors thereof. Also, a handle 54 is provided for each of the bags 14, 16 and 34, 36. Thus, the bags 14, 16 and 34, 36 may be easily toted, either individually or coupled together.

Figure 11:
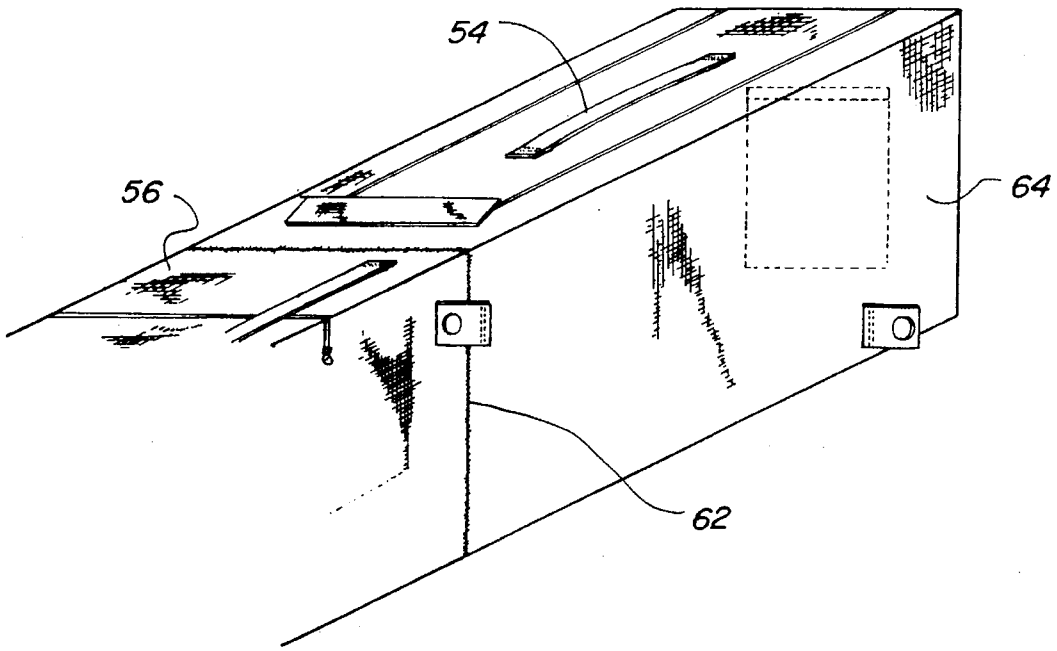
FIG. 11 is an isometric illustration of a first additional extension bag coupled to the first additional pannier bag.
Figure 10:
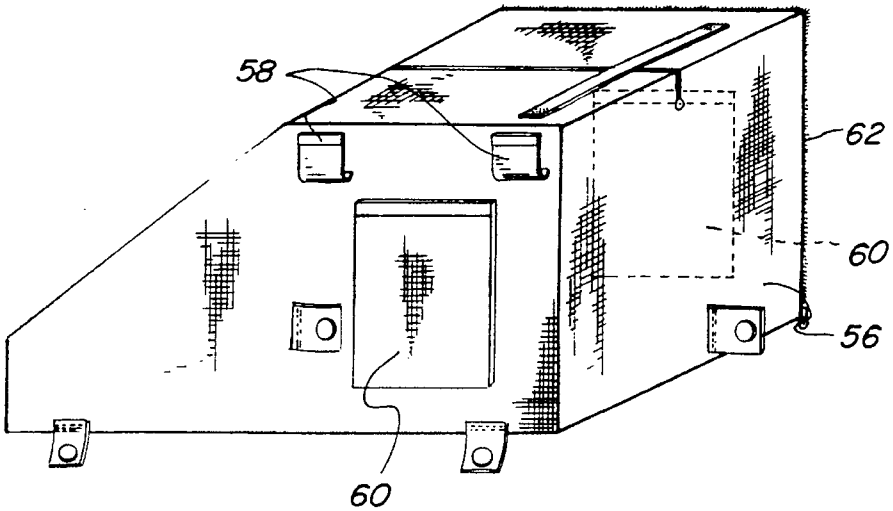
FIG. 10 is an isometric illustration of a first additional pannier bag.

Turning now to FIGS. 10 and 11, it can be shown that the present invention 10 further comprises a first additional pannier bag 56 provided with fastening means 42 which permit the first additional pannier bag to be removably coupled to any of the first or second bags 14, 16 and 34, 36, such as to a top surface of the first upper bag 14 or a lower surface of the first lower bag 16, for example. The first additional pannier bag 56 is provided with a pair of flashlight straps 58 for retaining a flashlight thereto and is further provided with at least one first additional pannier bag mesh pocket 60. In addition, a zipper 62 allows a first additional extension bag 64 to be removably coupled to the first additional pannier bag 56, as illustrated in FIG. 11. Also, handles 54 are provided on both the first additional pannier bag 56 and the first additional extension bag 64.

Figure 13:
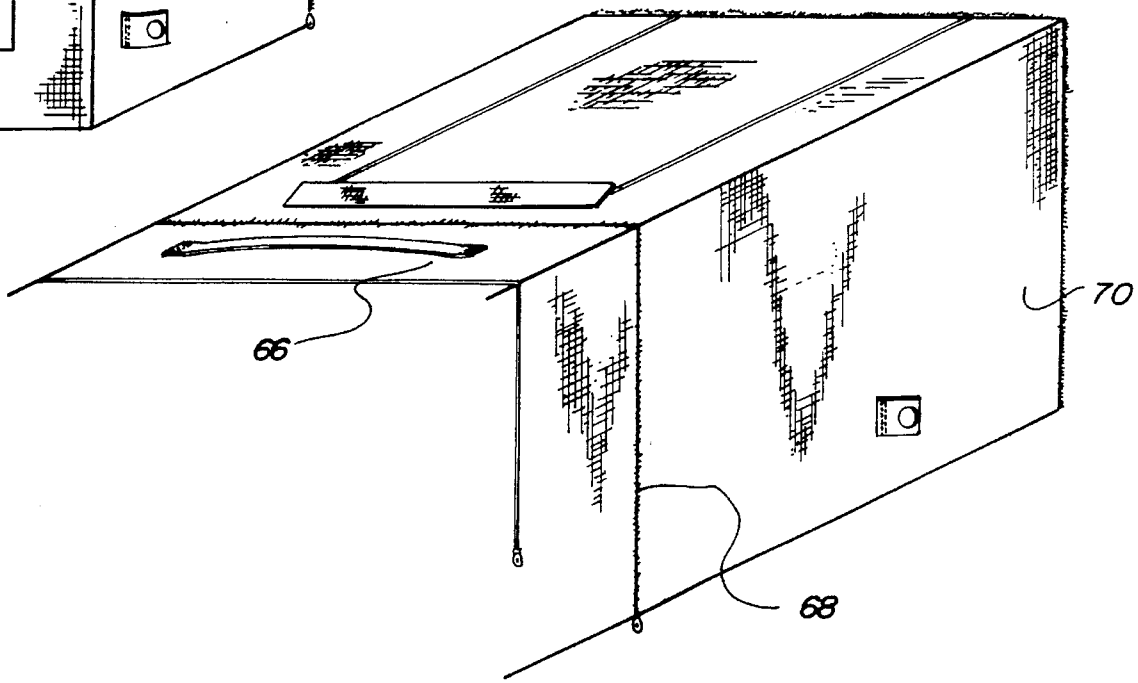
FIG. 13 is an isometric illustration of a second additional pannier bag extension coupled to the second additional pannier bag.
Figure 12:
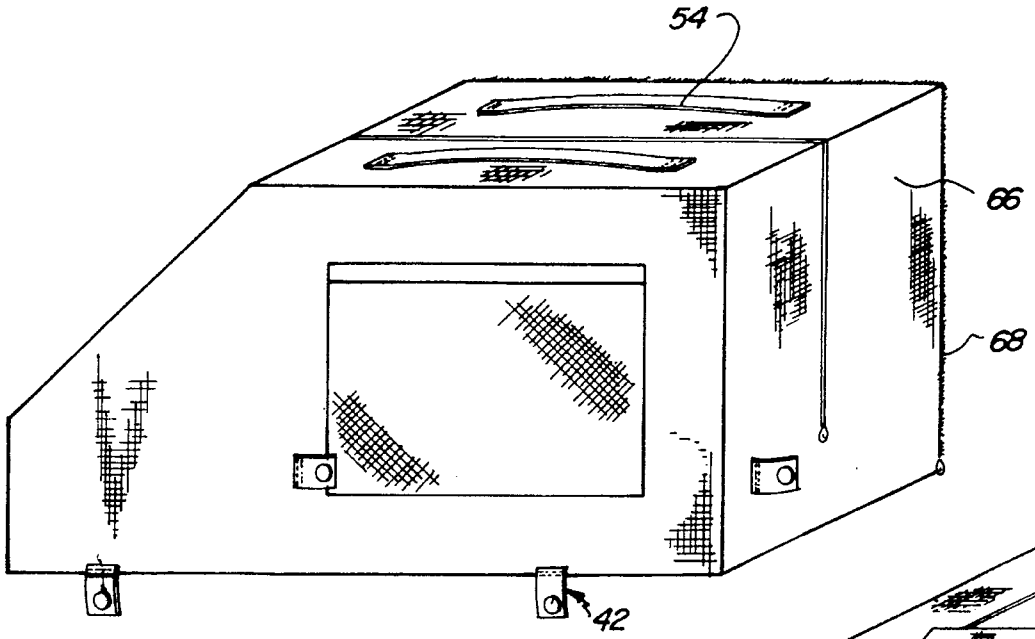
FIG. 12 is an isometric illustration of a second additional pannier bag.

Similar in construction to the first additional pannier bag 56, but yet slightly larger in size, is a second additional pannier bag 66 illustrated in FIGS. 12 and 13 of the drawings. The second additional pannier bag 66 is similarly equipped with retaining means 42 which allow it to be coupled to any of the first and second bags 14, 16 and 34, 36 in a manner similar to that of the first additional pannier bag 56. Also, a second additional pannier bag zipper 68 allows a second additional extension bag 70 to be removably coupled to the second additional pannier bag 66.

Figure 15:
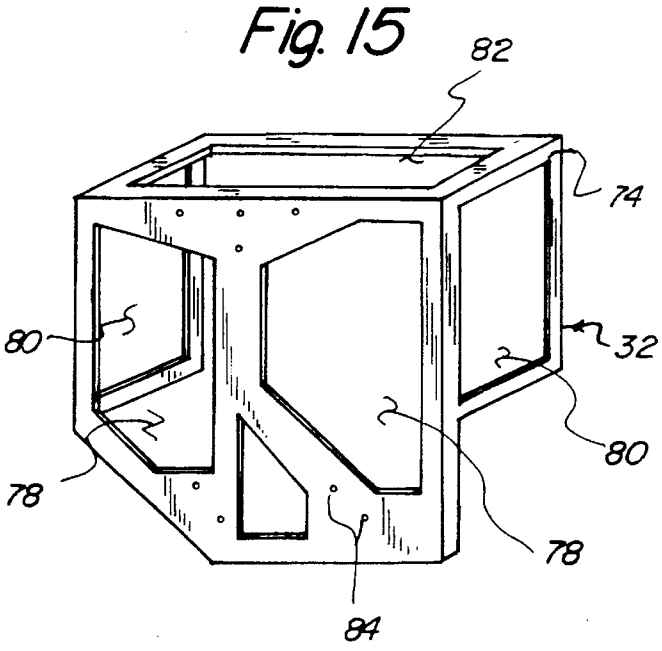
FIG. 15 is a front isometric view of a second lower bag space frame of the second pannier backpack.
Figure 16:
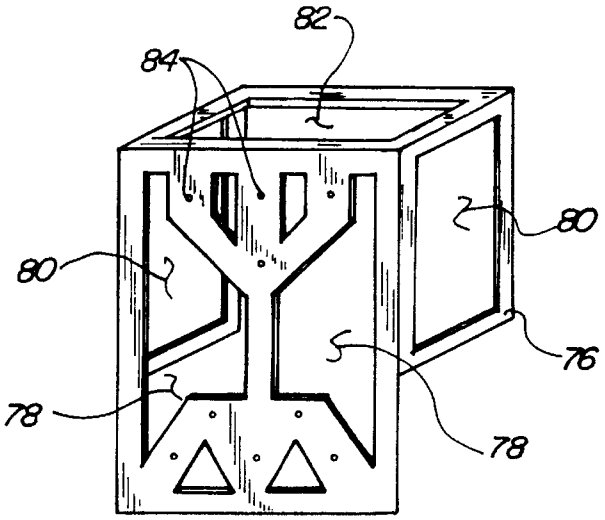
FIG. 16 is a front isometric view of an upper pannier bag space frame.
Figure 14:
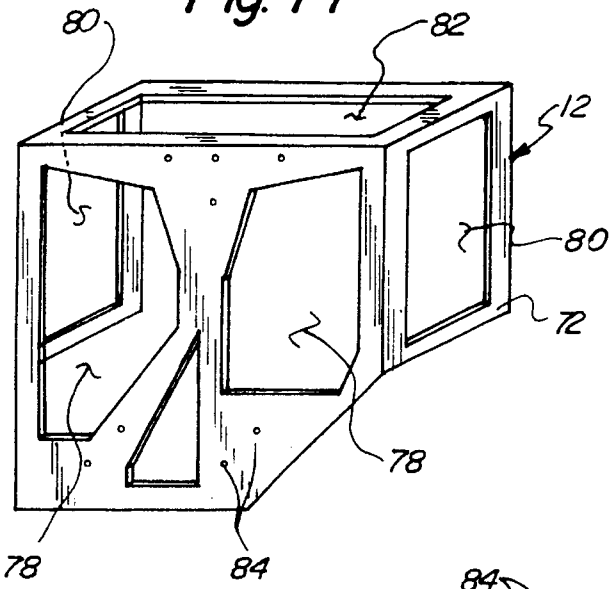
FIG. 14 is a front isometric view of a first lower bag space frame of the first pannier backpack.

Turning now to FIGS. 14 through 16, it can be shown that each of the first and second bags 14, 16 and 34, 36 includes an internal frame which provides rigidity and support to the organization. To this end, a first lower bag space frame 72 is illustrated in FIG. 14 for the first lower bag 16 of the first back pack pannier 12, a second lower bag space frame 74 is illustrated in FIG. 15 for the second lower bag 34 of the second back pack pannier 32, and an upper bag space frame 76 is illustrated in FIG. 16 for either of the upper bags 14, 36. Each of the space frames 72–76 is provided with a plurality of apertures therethrough, with each of the apertures providing a specific feature to the invention 10. The shoulder apertures 78 allow for a slight projection of the posterior shoulder bone into the bags, thereby providing comfort to the wearer of the device 10 when the bags 14, 16 and 34, 36 are worn upon the back, either singularly or together as the first and second back packs 12, 32. To this end, the shoulder straps 26, although illustrated in FIG. 2 as being attached to the first back pack pannier 12, may be attached to any of the individual bags 14, 16 and 34, 36. Referring back now to FIG. 14–16, the sidewall apertures 80 allow the auxiliary compartments 18, 22 to be constructed so as to permit communication between the interior of the auxiliary compartments and the interior of each of the bags 14, 16 and 34, 36. Finally, the top apertures 82 permit access through the lids into the interior of each of the bags 14, 16 and 34, 36. In addition, each of the space frames 72–76 is provided with a plurality of screw holes 84 which permit the attachment of the first and/or second back packs 12, 32 to a conventional unillustrated mountain bike rack system or alternatively, an unillustrated back pack frame, if so desired.

Figure 18:
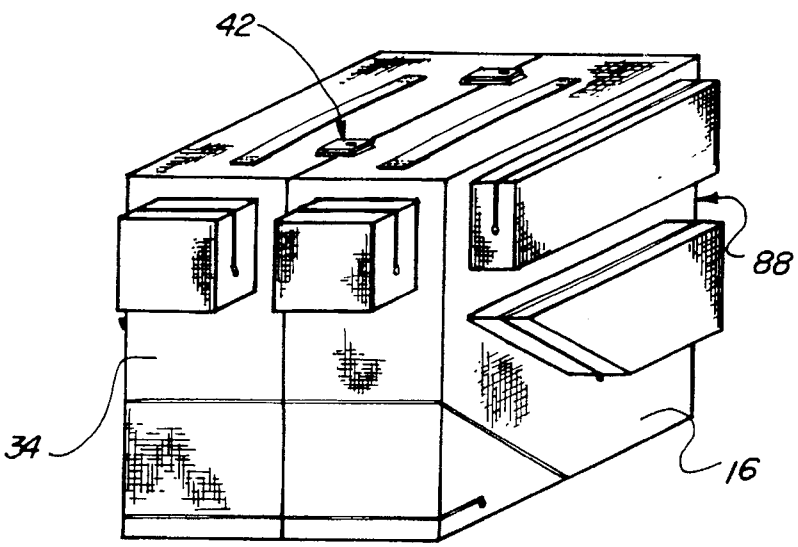
FIG. 18 is an isometric illustration of a lower pannier bag luggage assembly.
Figure 19:
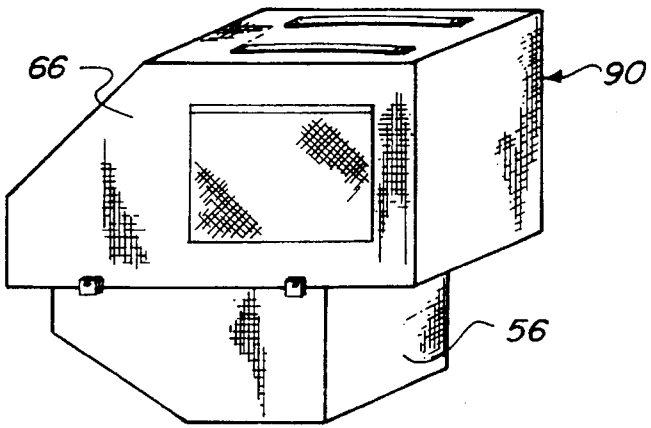
FIG. 19 is an isometric illustration of an additional pannier bag luggage assembly.
Figure 17:
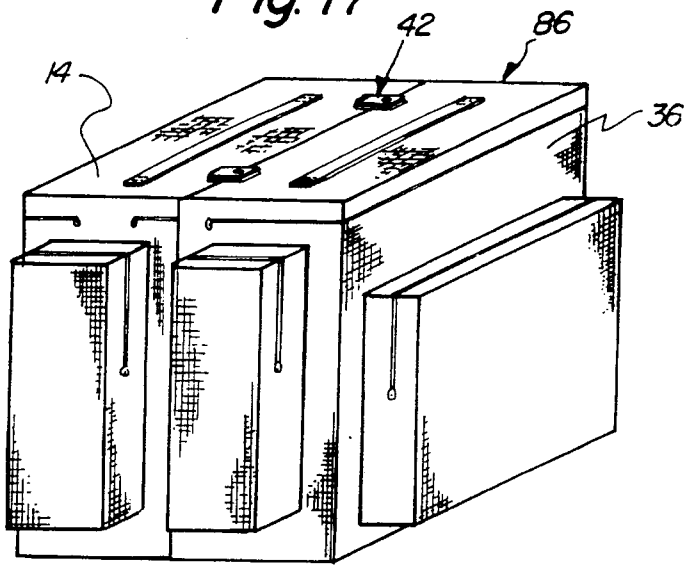
FIG. 17 is an isometric illustration of an upper pannier bag luggage assembly.

Referring now to FIGS. 17 through 19, it can be shown that he bags 14, 16 and 34, 36, as well as 56, 66 may be coupled together in pairs to form luggage assemblies. To this end, the first and second upper bags 14, 36 may be coupled together via the fastening means 42 to form an upper bag luggage assembly 86. Similarly, the first lower bag 16 and the second lower bag 34 may be coupled together to form a lower bag luggage assembly 88, and the first additional pannier bag 56 and second additional pannier bag 66 coupled together to form an additional pannier bag luggage assembly 90. Thus, the back packs 12, 32, as well as the additional pannier bags 56, 66, may be coupled together to form three unitary pieces of luggage 86–90 which may be checked as baggage on an airplane flight or the like, thereby decreasing the overall number of items checked.

Figure 20:
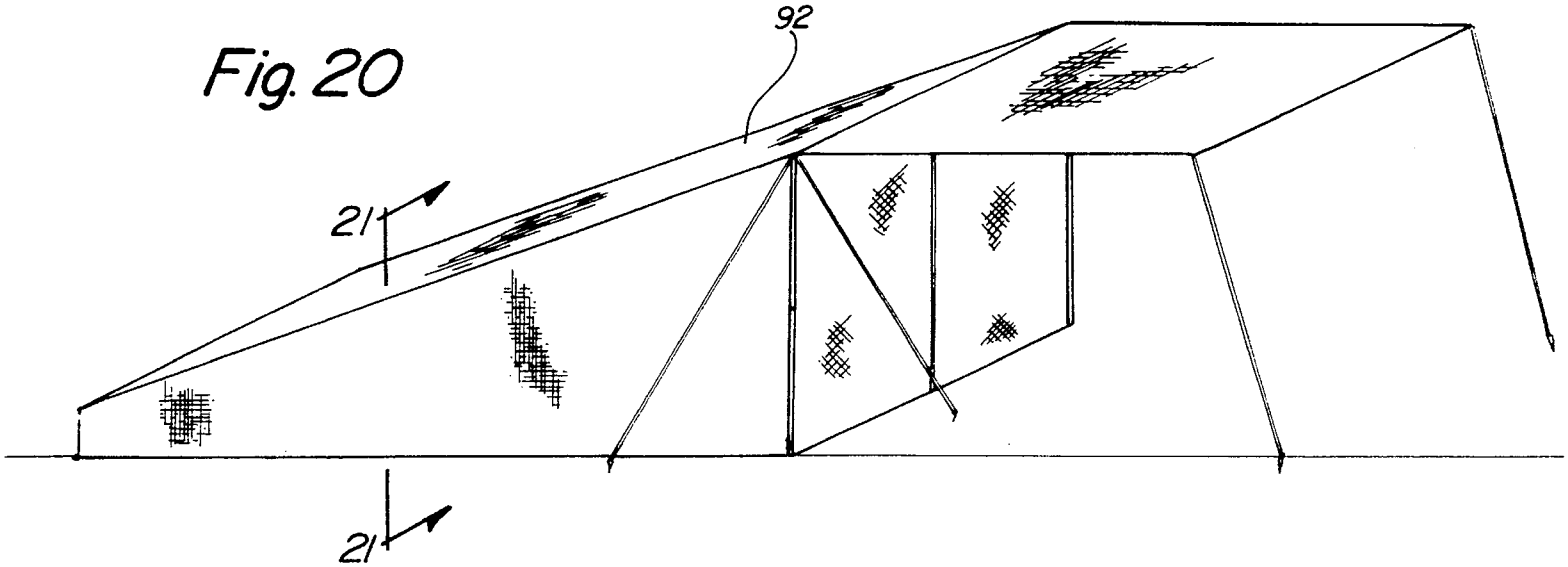
FIG. 20 is an isometric view of a tent assembly comprising a portion of the present invention.
Figure 21:
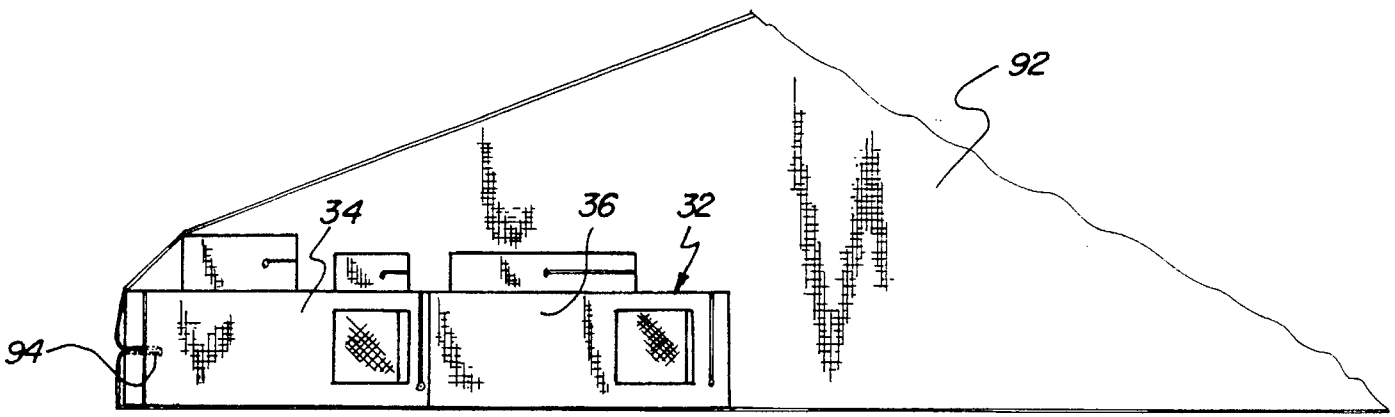
FIG. 21 is a cross sectional view taken along line 21—21 of FIG. 20.

Continuing on to FIGS. 20 and 21, a tent assembly 92 removably stowed within a tent pocket 94 of either of the lower bags 16, 34 may be provided. The tent assembly 92, as illustrated in these figures, is substantially wedge shaped and utilizes the associated back pack pannier 12 or 32 to anchor an end thereof, with the aforementioned tent poles supporting another end thereof.

Figure 22:
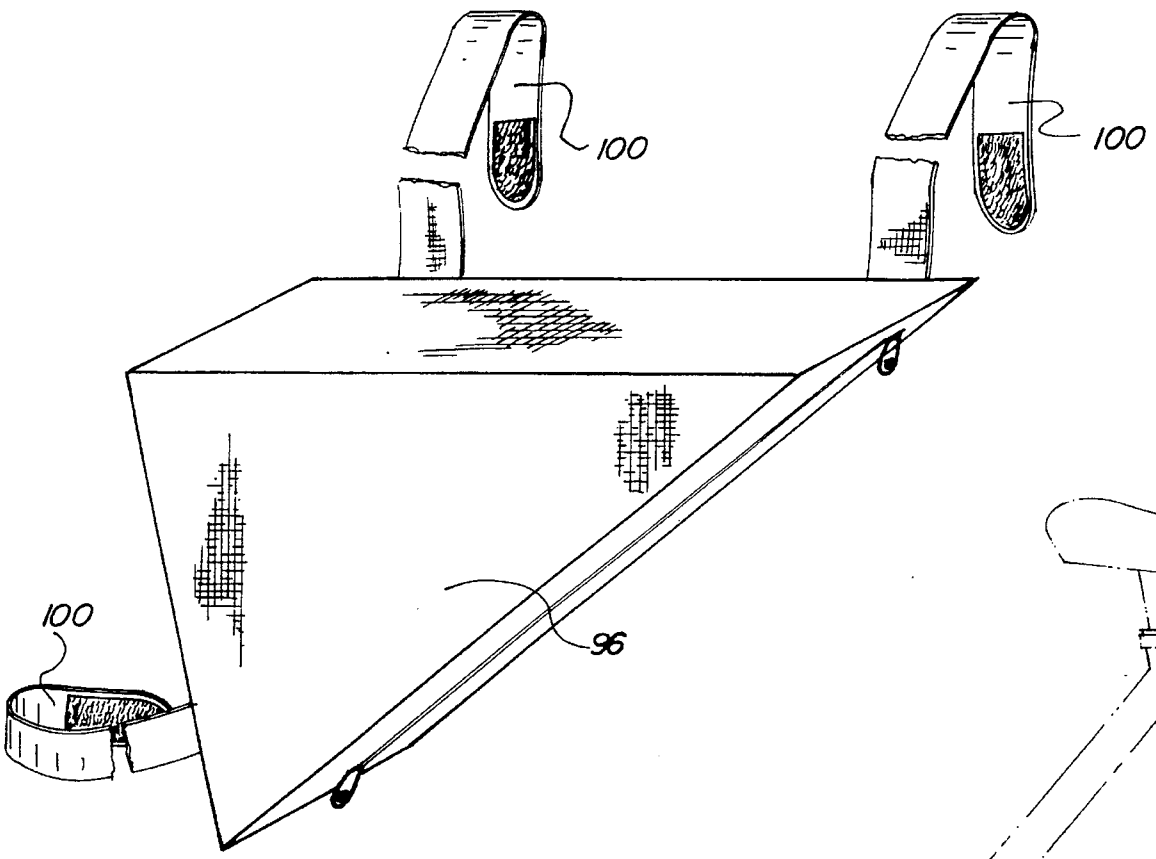
FIG. 22 is an isometric view of a bicycle pack comprising a portion of the present invention.
Figure 23:
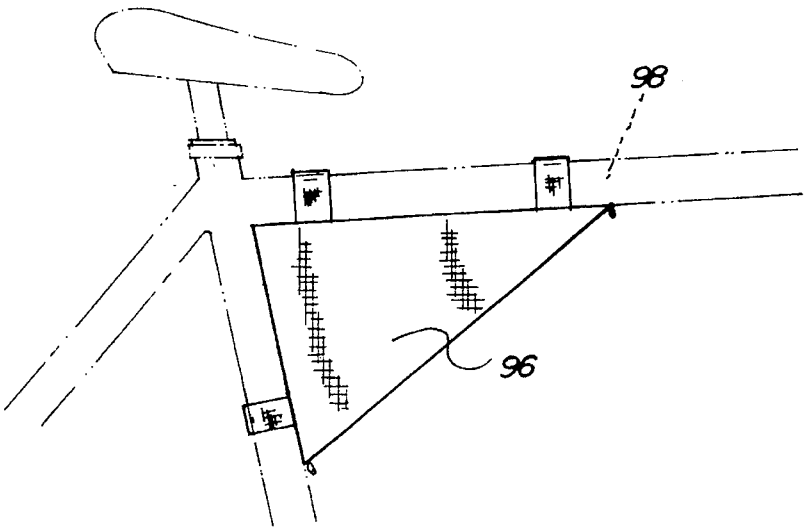
FIG. 23 is a side elevational view of the bicycle pack.

FIGS. 22 and 23 illustrate a possible configuration for any one of the auxiliary compartments 18–22. Thus, it can be seen that the bicycle pack 96 illustrated in these figures is adapted to be removably attached to a bicycle 98 through a plurality of velcro attached bicycle pack straps 100. As such, the bicycle pack straps 100 may be utilized to join the bicycle pack 96 to either of the back packs 12, 32 or the additional pannier bags 56, 66. In addition, the bicycle may be provided with the fastening means 42 to provide for coupling to the bags 14, 16, 34, 36, 56, or 66.

Figure 24:
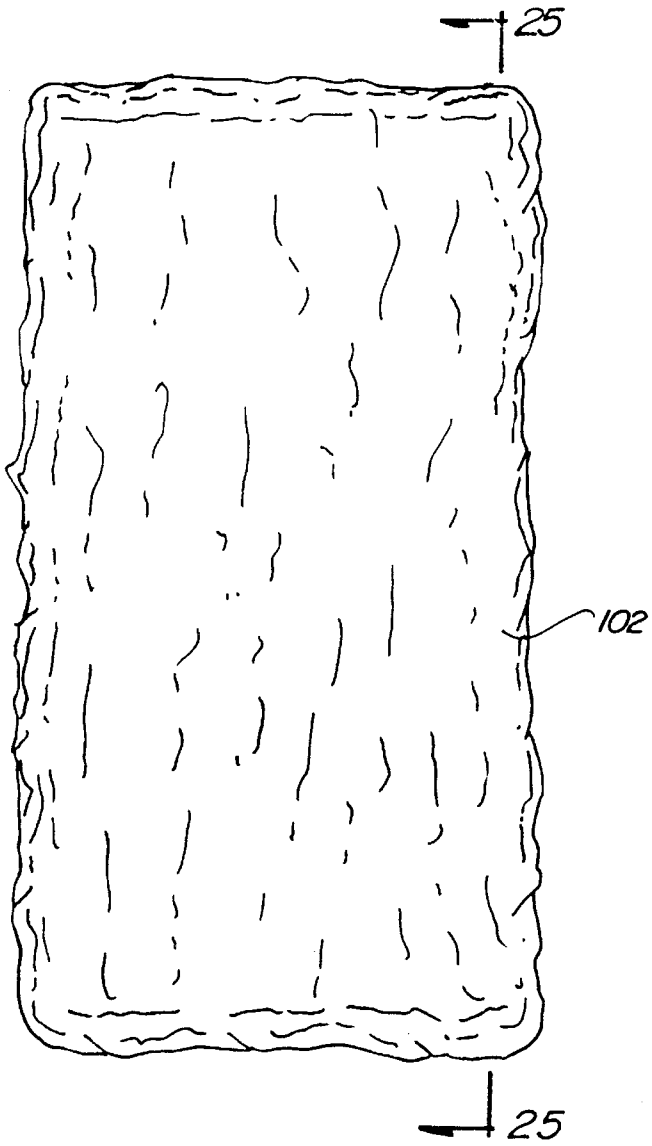
FIG. 24 is a rear elevational view of an elastic pack cover extending over the first backpack.
Figure 25:
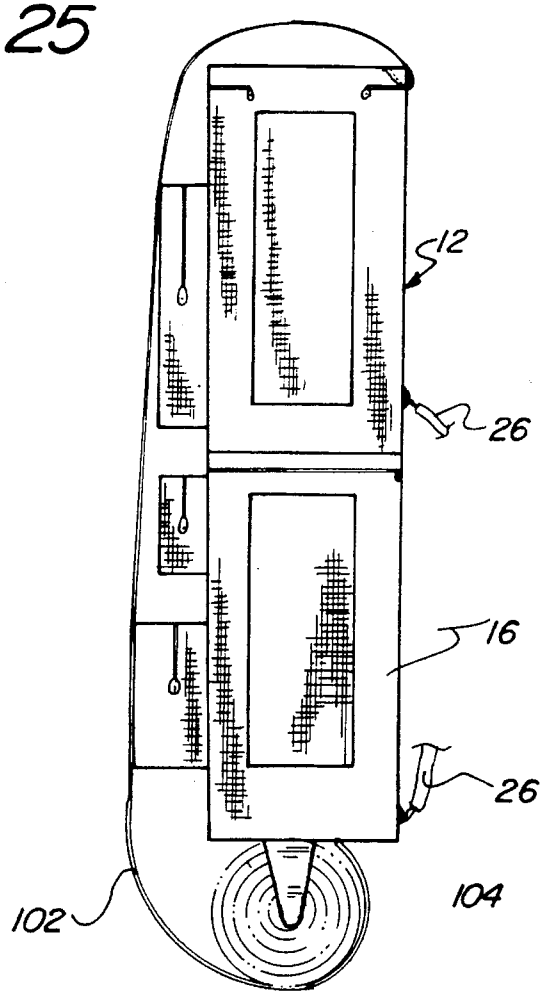
FIG. 25 is a cross-sectional view taken along line 25—25 of FIG. 24.

FIGS. 24 and 25 illustrate an elastic pack cover 102 stored upon a removably attached reel 104 beneath either of the lower bags 16, 34. The elastic pack cover 102 is configured to be unrolled from the reel 104 and extended about the back pack pannier 12 to substantially protect the back pack pannier from rain and the like. Additionally or alternatively, the elastic pack cover 102 may be configured as a poncho by simply providing the pack cover with a head opening which allows a wearer of the back pack pannier 12 to extend the elastic pack cover over the backpack pannier as well as himself to position the individuals head through the head opening, whereby the pack cover is draped over both the back pack pannier and the individual.

Figure 26:
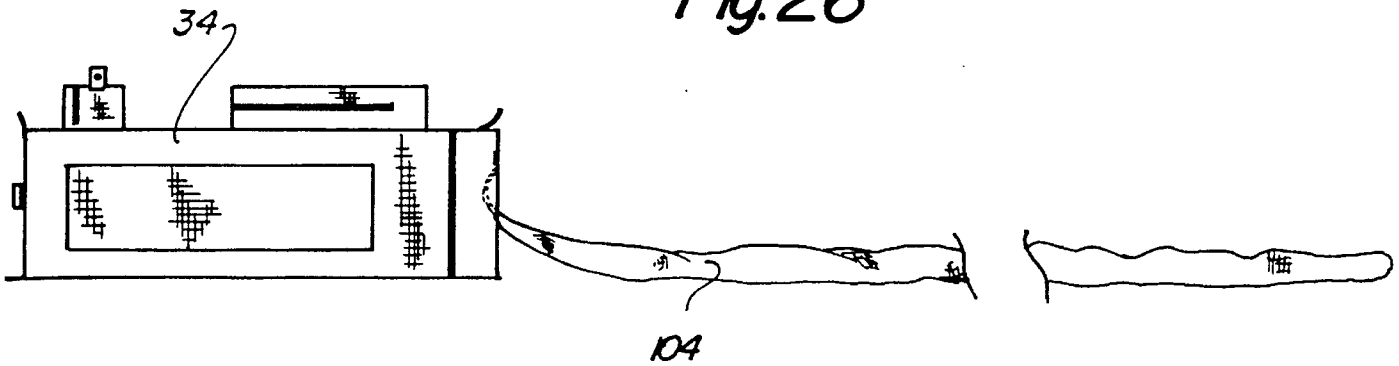
FIG. 26 is a side elevation view of the second lower bag including sleeping bag structure.

Lastly, FIG. 26 illustrates that a sleeping bag structure 104 can be removably stowed within a sleeping bag compartment within any of the panniers bags, and preferably within the second lower bag 34, as illustrated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. Modular back pack pannier luggage comprising:

a first back pack pannier having a first upper bag removably coupled to top end of a first lower bag;

first retaining means for retaining said back pack pannier upon a back of a first individual; and, a second back pack pannier having a second upper bag removably coupled to a top end of a second lower bag; and second retaining means for retaining said back pack pannier upon a back of a second individual, wherein said first and second upper bags are couplable together to form an upper bag luggage assembly, and said first lower bag and said second lower bag are couplable together to form a lower bag luggage assembly.

2. The new modular back pack pannier as recited in claim 1, wherein said bags each comprise a frame means for rigidifying said bag.

3. The new modular back pack pannier as recited in claim 2, wherein said frame means comprises a space frame having a pair of shoulder apertures which allow for a slight projection of a posterior shoulder bone of said individual into said bags, thereby providing comfort to a wearer of said back pack pannier.

4. The new modular back pack pannier as recited in claim 3, wherein said retaining means comprises a pair of shoulder straps.

5. The new modular back pack pannier as recited in claim 4, and further comprising a first additional pannier bag removabley coupled to said back pack pannier.

6. The new modular back pack pannier as recited in claim 5, and further comprising a second additional pannier bag removably coupled to said back pack pannier, wherein said additional pannier bags are couplable together to form additional pannier bag luggage.

7. The new modular back pack pannier as recited in claim 6, and further comprising a tent removably stored within said back pack pannier, said tent being extendable therefrom to be at least partially anchored to a ground surface by a weight of said back pack pannier.

8. The new modular back pack pannier as recited in claim 7, and further comprising an elastic pack cover stored upon a removably attached reel beneath said lower bag, said elastic pack cover being configured to be unrolled from said reel and extended about said back pack pannier to substantially protect said back pack pannier.

9. A new modular back pack pannier luggage comprising:

a first back pack pannier having a first upper bag removably coupled to a top end of a first lower bag, said first upper bag having a plurality of upper bag auxiliary compartments each having zippered openings which allow for storage of articles therewithin, said first upper bag further including an upper bag mesh pocket coupled to a side of said first upper bag for retaining small articles in an easily accessible manner and retaining damp articles for drying, said first lower bag having a plurality of lower bag auxiliary compartments with a waist pack compartment removably coupled to a rear of said first lower bag, said waist pack compartment being operable to be removed from said first lower bag, whereby it may be attached to an individual, said waist pack compartment further being operable to be attached to a front of said first lower bag, whereby it functions to provide lumbar support, said first lower bag and said first upper bag having a pair of colinearly arranged pole pockets for retaining a tent pole therein for storage and to rigidifies said removable coupling between said first upper bag and said first lower bag;

first retaining means for retaining said back pack pannier upon a back of a first individual;

a second back pack pannier having a second upper bag removably coupled to a top end of a second lower bag, said second upper bag having a plurality of upper bag auxiliary compartments each having zippered openings which allow for storage of articles therewithin, said second upper bag further including an upper bag mesh pocket coupled to a side of said second upper bag for retaining small articles in an easily accessible manner and retaining damp articles for drying, said second lower bag having a plurality of lower bag auxiliary compartments with a waist pack compartment removably coupled to a rear of said second lower bag, said waist pack compartment being operable to be removed from said second lower bag, whereby it may be attached to an individual, said waist pack compartment further being operable to be attached to a front of said second lower bag, whereby it functions to provide lumbar support, said second lower bag and said second upper bag having a pair of colinearly arranged pole pockets for retaining a tent pole therein for storage and to rigidifies said removable coupling between said second upper bag and said second lower bag; and, second retaining means for retaining said back pack pannier upon a back of a second individual, wherein said first and second upper bags are couplable together to form an upper bag luggage assembly, and said first lower bag and said second lower bag are couplable together to form a lower bag luggage assembly.

10. The new modular back pack pannier as recited in claim 9, wherein said bags each comprise a frame means for rigidifying said bag.

11. The new modular back pack pannier as recited in claim 9, wherein said frame means comprises a space frame having a pair of shoulder apertures which allow for a slight projection of a posterior shoulder bone of said individual into said bags, thereby providing comfort to a wearer of said back pack pannier.

12. The new modular back pack pannier as recited in claim 11, wherein said retaining means comprises a pair of shoulder straps.

13. The new modular back pack pannier as recited in claim 12, and further comprising a first additional pannier bag removably coupled to each of said back pack panniers.

14. The new modular back pack pannier as recited in claim 13, and further comprising a second additional pannier bag removably coupled to each of said back pack panniers, wherein said additional pannier bags are couplable together to form additional pannier bag luggage.

15. The new modular back pack pannier as recited in claim 14, and further comprising a tent removably stored within each of said back pack panniers, said tent being extendable therefrom to be at least partially anchored to a ground surface by a weight of each of said back pack panniers.

16. The new modular back pack pannier as recited in claim 15, and further comprising an elastic pack cover stored upon a removably attached reel beneath said second lower bag, said elastic pack cover being configured to be unrolled from said reel and extended about each of said back pack panniers to substantially protect each of said back panniers.

* * * * *